US005934814A

United States Patent [19]

Matsuoka et al.

[11] Patent Number: 5,934,814

[45] Date of Patent: Aug. 10, 1999

[54] CASING FOR DISPENSING ROD-LIKE COSMETIC

[75] Inventors: Katsumi Matsuoka; Yoichi Iwamoto, both of Tokyo, Japan

[73] Assignee: Katsushika Co., Ltd., Tokyo, Japan

[21] Appl. No.: 08/663,182

[22] PCT Filed: Apr. 27, 1994

[86] PCT No.: PCT/JP94/00702

§ 371 Date: Jun. 17, 1996

§ 102(e) Date: Jun. 17, 1996

[87] PCT Pub. No.: WO95/16373

PCT Pub. Date: Jun. 22, 1995

[30] Foreign Application Priority Data

Dec. 16, 1993 [JP] Japan ..... 5-072545 U

[51] Int. Cl.[6] ..... A45D 40/04

[52] U.S. Cl. ..... 401/78; 401/87

[58] Field of Search ..... 401/78, 75–77, 401/6, 87, 68

[56] References Cited

U.S. PATENT DOCUMENTS 1,085,118 7/1914 Pergeaux ..... 401/87
2,074,016 3/1937 Coryell ..... 401/78
2,303,459 11/1942 Noel ..... 4012/78
5,234,275 8/1993 Gueret ..... 401/78

*Primary Examiner*—Jerome Donnelly
*Attorney, Agent, or Firm*—Dvorak & Orum

[57] ABSTRACT

A retainer cylinder in which a cosmetic stick is fitted and held is provided with an engagement projection on a side surface therof and inserted in a guide cylinder so that the retainer cylinder can be moved slidingly in the vertical direction. A side wall of the guide cylinder is provided with an axially elongated guide groove through which the engagement projection is passed, and an annular locking recess is formed around the portion of an outer surface of the guide cylinder which is below a lower end of the guide groove. This guide cylinder is inserted in a sleeve so that the guide cylinder can be turned. The sleeve is provided at its lower portion with a locking rib engageable with the locking recess, whereby the sleeve is combined with the guide cylinder so that the sleeve does not come off from the guide cylinder, the sleeve being provided in its inner surface with a helical knurled thread having innumerable projections and recesses. A free end portion of the engagement projection of the retainer cylinder has an engagement surface engageable with the helical knurled thread on the sleeve and having innumerable projections and recesses.

1 Claim, 4 Drawing Sheets

CASING FOR DISPENSING ROD-LIKE COSMETIC

FIELD OF THE INVENTION

The present invention relates to a casing for accommodating a rod-like cosmetic such as a lip stick; in particular, it pertains to a dispenser casing for a rod like cosmetic, which can be manufactured with improved productivity.

BACKGROUND ART

Conventionally, container for a rod-like cosmetics such as a lip stick is provided therein with a helical dispensing mechanism whereby the rod-like cosmetic is dispensed by a turning operation. Such a helical dispensing mechanism is comprised of a retainer cylinder for retaining the rod-like cosmetic therein, a guide cylinder for inhibiting the turning motion of the retainer cylinder, a helical cylinder for causing a vertical movement of the retainer cylinder, as well as an outer case in the form of a combination of a plurality of cylindrical bodies, such as a sleeve, an outer cylinder, an intermediate cylinder, a cap, etc. Thus, Japanese Utility Model Application Laid-open Publication No. 56-136,608 discloses a structure which is provided with a helical groove in the inner wall of the outer cylinder in the form of a sleeve, wherein the sleeve is integrated with the helical cylinder thereby to reduce the number of components and hence the manufacturing cost.

Among other things, however, an engagement projection protruding from the retainer cylinder extends through a guide groove, which is elongate in the axial direction of the guide cylinder, so as to be engaged with the helical groove. Therefore, whenever the retainer cylinder is assembled into the container for red-like cosmetic, the engagement projection must be inserted into the guide groove and engaged with the helical groove, thereby necessitating a difficult assembly. Also, in recent years, measures have been taken so that the assembling operation or the container for rod-like cosmetic is performed automatically. However, from the viewpoint of automated assembly also, it is necessary to perform a positioning for inserting the engagement projection into the guide groove, and another positioning for engaging the engagement projection into the helical groove, and such positioning steps have been recognized as obstacles to the desired automation.

DISCLOSURE OF THE INVENTION

According to the invention, a rod-like cosmetic 1 is fitted and held in a retainer cylinder 2 having a side wall which is provided with an engagement projection 3, and arranged inside of a guide cylinder 4 so as to be slidingly movable in the vertical direction. The guide cylinder 4 has a side wall that is formed with an axially elongate guide groove 5 through which extends the engagement projection 3, and also with an annular locking groove 10 at a location below the guide groove 5. The guide cylinder 4 is inserted into a sleeve 11 such that the guide cylinder 4 can be turned. This sleeve 11 has a lower portion provided with an annular locking rib 20 which is engageable with the locking groove 10 such that the sleeve 11 is connected to the guide cylinder 4 and prevented from disengagement therefrom. The sleeve 11 has an inner wall provided with helical knurls 13 comprised of a number of protrusions and depressions. The engagement projection 3 of the retainer cylinder 2 has a tip end portion provided with an engagement surface 15 which is comprised of a number of protrusions and depressions engage able with the helical knurls 13 or the sleeve 11. The present invention provides a container for a rod-like cosmetic having the above mentioned structure.

According to the wall of the sleeve 11 invention, as mentioned above, the inner is provided with helical knurls 13 comprised of a number of protrusions and depressions, the engagement projection 3 of the retainer cylinder 2 is engaged with the helical knurls 13. This means chat the sleeve 11 is formed integrally with the helical cylinder and it is thus possible to reduce the number of components. Moreover, the engagement groove in the inner wall of the sleeve 11 is comprised of helical knurls 13 which can be formed by a press forming process. Thus, the sleeve 11 can be formed from aluminum or the like metal, making it possible to reduce the manufacturing cost without spoiling a high-grade appearance. Also, the helical groove is in the form of helical knurls 13 comprised of a number of protrusions and depressions, and the tip end surface of the engagement projection 3 is provided with the engagement surface 15 which is engage able with the helical knurls 13, and it is thus possible to perform assembling steps without requiring positioning operations when the engagement projection 3 is engaged with the helical knurls 13. Such an arrangement is easy to deal with automation which serves to reduce the assembling cost. Therefore, the present invention provides a dispenser casing which is capable of reducing the components cost, manufacturing cost and assembling cost, and which can be provided with an extremely high manufacturing productivity.

BEST MODE FOR CARRYING OUT THE INVENTION

Figure 1:
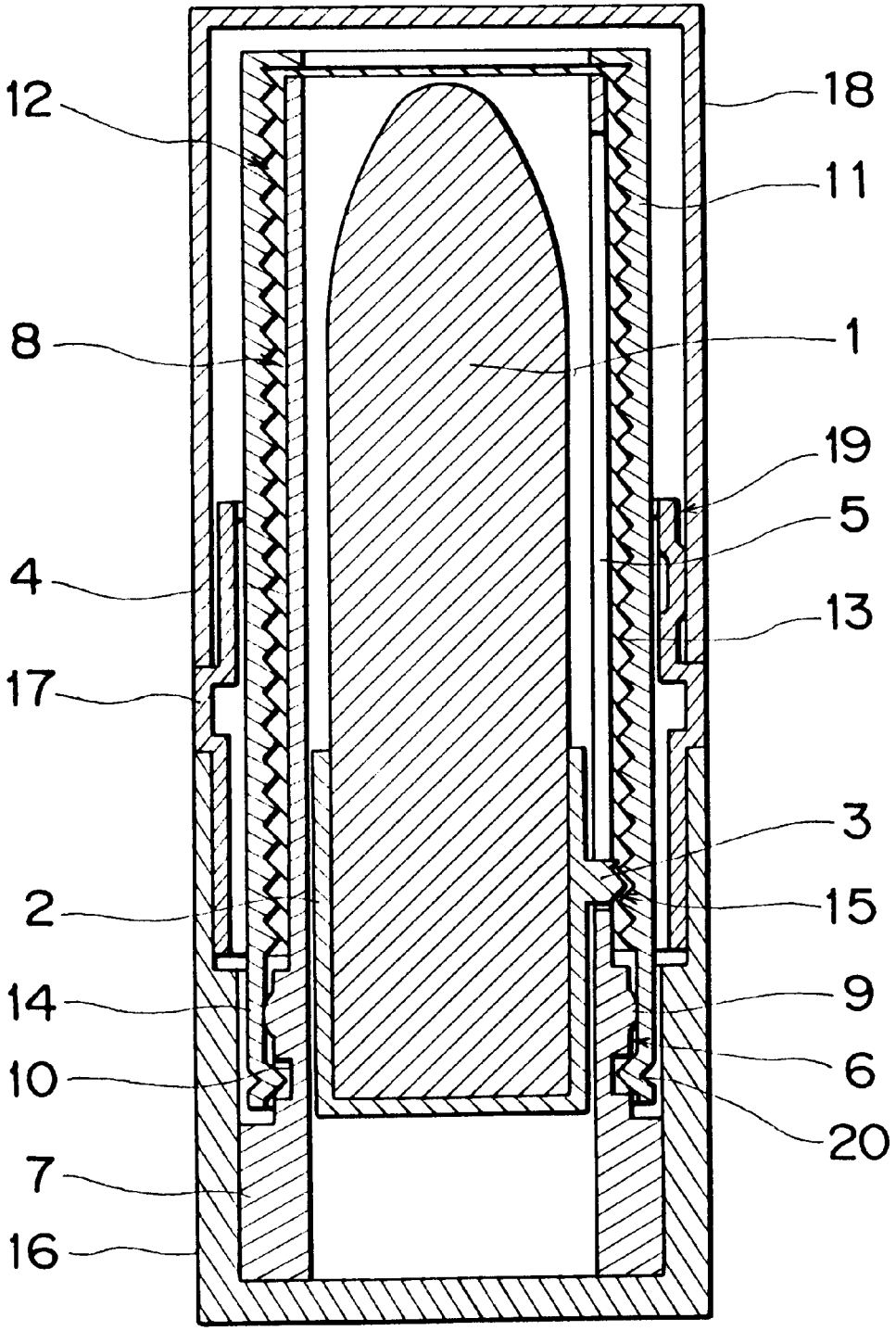
FIG. 1 is a front-elevational view in longitudinal section of a dispenser casing for a rod-like cosmetic according to one embodiment of the present invention.
Figure 2:
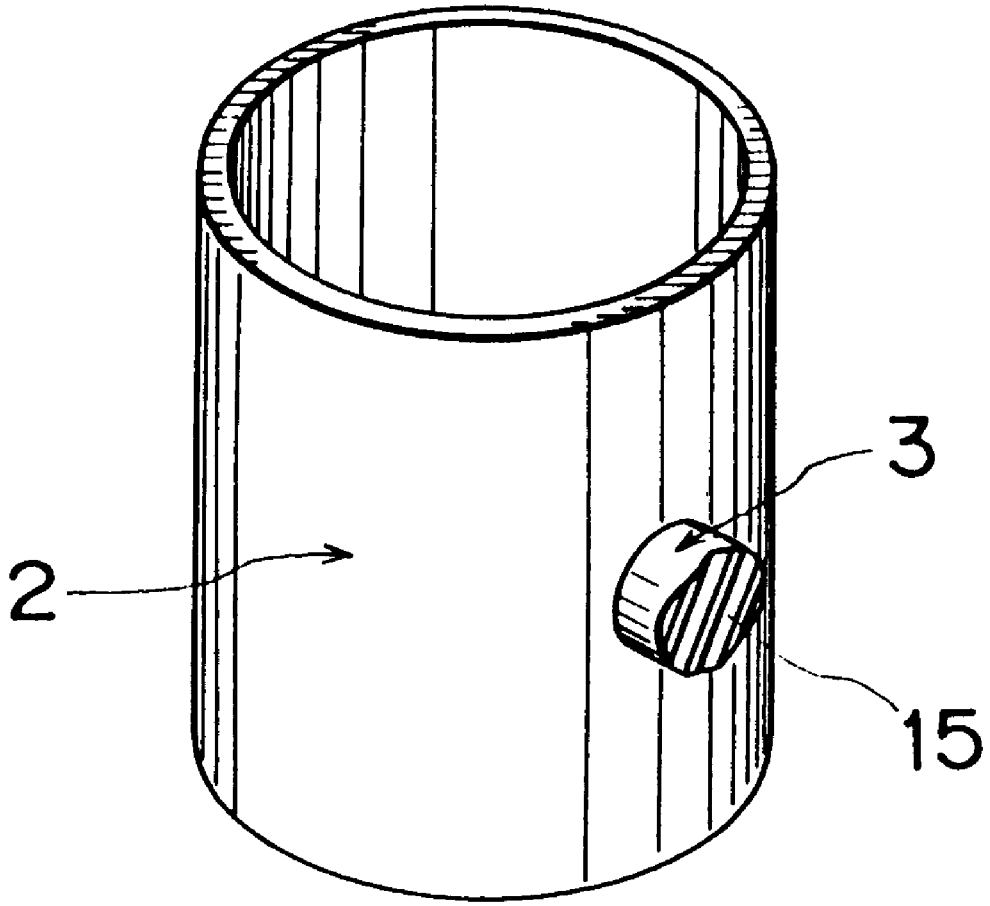
FIG. 2 is a perspective view of the retainer cylinder in the same embodiment of the present invention.
Figure 3:
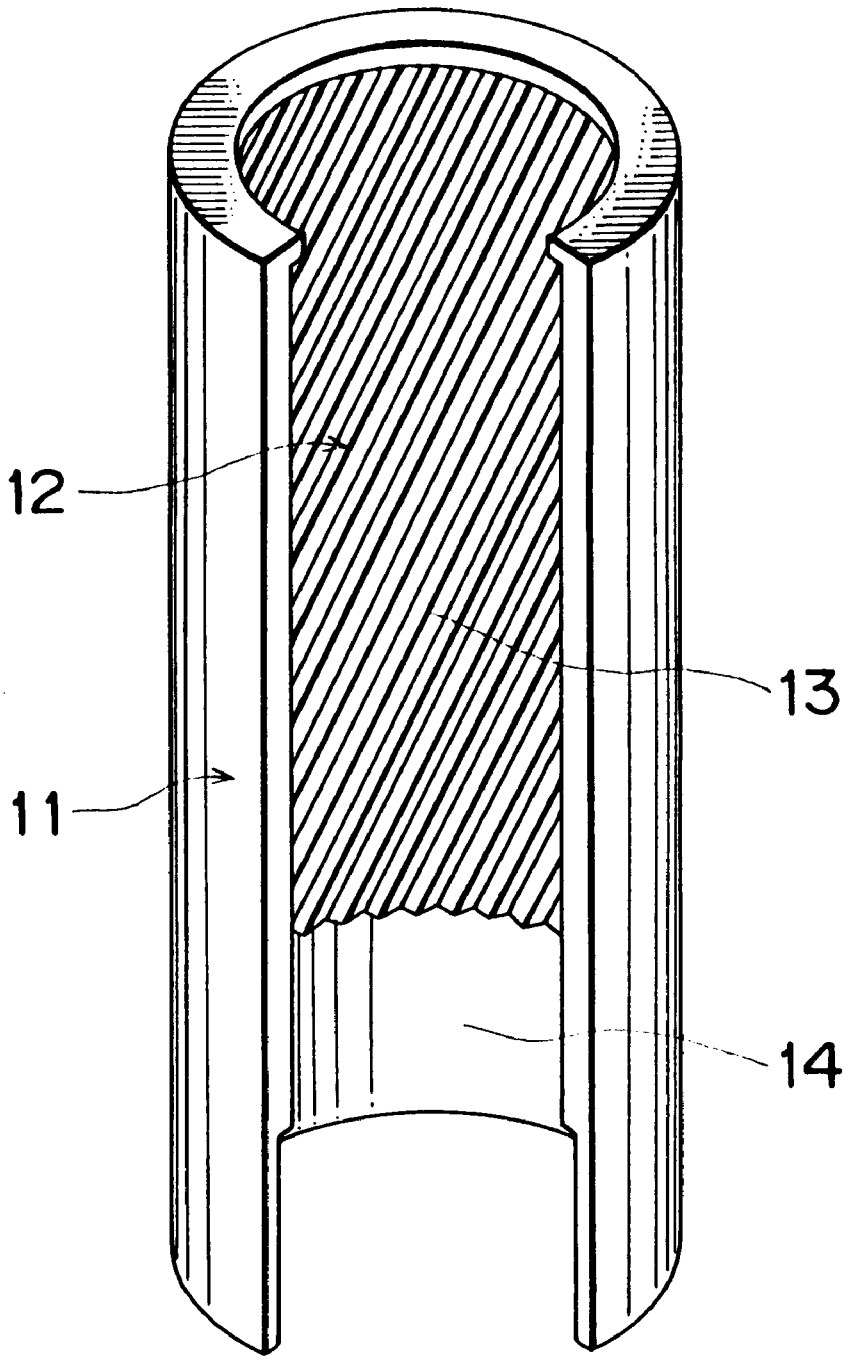
FIG. 3 is a perspective view, part' partlyin section, of the sleeve in the same embodiment of the present invention.
Figure 4:
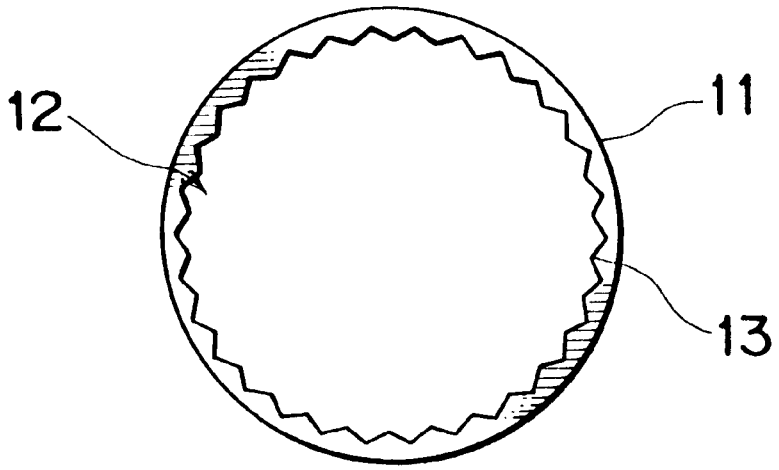
FIGS. 4 and 5 are sectional views showing different embodiments in term of shape of the knurls in the inner wall of the sleeve.
Figure 5:
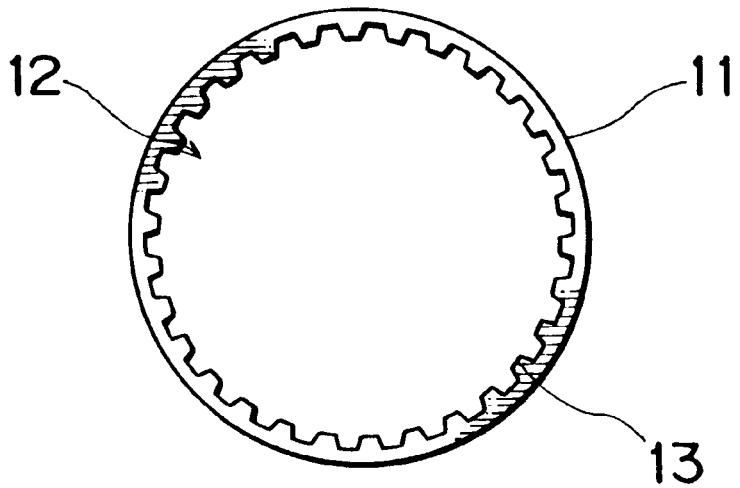

For a more detailed illustration, the present invention will now be explained with reference to the accompanying drawings. A retainer cylinder 2 for fitting and holding a rod like cosmetic 1 therein has a side wall from which protrudes an engagement projection 3. The retainer cylinder 2 is accommodated within a guide cylinder 4 so that it can be moved in the vertical direction. The guide cylinder 4 has a side wall formed with an axially elongate guide groove 5 through which extends the engagement projection 3 of the retainer cylinder 2. Furthermore, the guide cylinder 4 has a lower portion which is situated below the lower end of the guide groove 5, and this lower portion forms a sliding contact portion 6 with an increased diameter. A stopper portion 7 with a further increased diameter is arranged below the sliding contact portion 6. A retainer portion 8 is formed above the sliding contact portion 6. The sliding contact portion 6 has an outer side wall which is faced opposite to the retainer portion 8 and provided with a resilient ridge 9. An annular locking groove 10 is formed below the resilient ridge 9.

The retainer portion 8 of the guide cylinder 4 is inserted into inside of the sleeve so that it can be turned. The lower end of the sleeve 11 covers the guide cylinder 4 up to its annular locking sleeve. The sleeve 11 has an inner wall in the form of a helical portion 12 which is faced opposite to the retainer portion 8 of the guide cylinder 4, and provided with helical knurls 13 comprised of a number of protrusions and depressions. The portion of the sleeve 11 which is situated below the helical portion 12 forms a connecting portion 14 with a reduced wall thickness. The engagement projection 3 of the retainer cylinder 2 has a tip end surface provided with protrusions and depressions corresponding to the helical knurls 13 of the sleeve 1', forming a helical surface 15 which is engageable with the helical knurls 13. The connecting portion 14 of the sleeve 11 has an inner wall with which the resilient projection 9 of the guide cylinder 4 is brought into a sliding contact. The inner wall of the sleeve is provided with an annular locking rib 20 which can be engaged from outside into the locking groove 10 of the guide cylinder 4 radially inwards. As a result, the sleeve 1; is connected to the guide cylinder 4 so that it can be turned while being prevented from disengagement therefrom. Thus, by turning the sleeve 11 and the guide cylinder 4 relative to each other, a sliding frictional resistance is generated due to a sliding contact of the resilient projection 9 of the guide cylinder 4, with the connecting portion 14 of the sleeve 11, thereby providing a refined feel upon the turning operation. On such occasion, because the engagement projection is in engagement with the helical knurls 13 so that the retainer cylinder 2 is prevented from a turning motion by the guide groove 5 of the guide cylinder 4, the retainer cylinder 2 undergoes a vertical motion as a result of the helical action.

The stopper portion 7 at the lower end of the guide cylinder 4 is fixedly secured in place within an outer cylinder 16. This outer cylinder 16 has an upper end to which an intermediate cylinder 17 is fixedly secured. The intermediate cylinder 17 has an upper end which protrudes upwardly from the outer cylinder 16, thereby forming a fitting portion 19 over which a cap 18 can be detachably fitted. Incidentally, it is possible to form the outer cylinder 16 and the intermediate cylinder 17 integrally with each other. It is also possible to form the dispenser casing for the rod-like cosmetic by means of the retainer cylinder 2, guide cylinder 4 and the sleeve 11.

INDUSTRIAL SUSCEPTIBILITY

The present invention is applicable, not only to the above-mentioned dispenser casing for the rod-like cosmetic, but also to a casing accommodating a rod-like body and causing a vertical movement of the rod-like body by a helical dispensing mechanism, and it can be applied in the field of container casings for chalks, rod-like pastes and the like, as well as writing instruments.

We claim:

1. A dispenser casing for a rod-like cosmetic, which comprises at least:

a retainer cylinder in which a rod-like cosmetic is fitted and held, having a side wall which is provided with an engagement projection;

a guide cylinder in which said retainer cylinder is vertically slidably accommodated, said guide cylinder being formed with an axially elongate guide groove through which extends said engagement projection, and provided with an annular locking groove at a location below said guide groove; and a sleeve in which said guide cylinder is inserted so that it can be turned, said sleeve having a lower portion provided with a locking rib which is engageable with said locking groove so that the guide cylinder is connected to the sleeve and prevented from disengagement therefrom, said sleeve further having an inner wall provided with helical knurls comprised of a number of helical grooves which are smaller in width than said engagement projection of the retainer cylinder having a tip end surface which is opposite to said helical knurls of the sleeve, which said tip end surface of the engagement projection is provided with a helical surface comprised of a number of protrusions and depressions which are simultaneously engageable with a plurality of neighboring ones of said helical knurls of the sleeve.

* * * * *